US005639523A

United States Patent [19]

Ellis

[11] Patent Number: 5,639,523

[45] Date of Patent: Jun. 17, 1997

[54] DECORATIVE SHEET MATERIAL

[76] Inventor: Dana R. Ellis, 515 N. Pollard St., Arlington, Va. 22204

[21] Appl. No.: 375,298

[22] Filed: Jan. 20, 1995

[51] Int. Cl.[6] ..... B65D 33/18; B65D 5/18

[52] U.S. Cl. ..... 428/34.2; 428/34.3; 428/35.2; 428/35.3; 428/35.9; 428/40.1; 428/178; 428/36.5; 206/484; 206/484.2; 206/521; 383/84; 383/109; 383/113; 383/116; 229/3.1; 229/3.5 R; 229/3.5 MF; 229/174; 229/175; 229/922

[58] Field of Search ..... 383/109, 119, 383/105, 110, 113, 116, 84; 206/594, 484, 484.1, 484.2, 521; 428/34.2, 34.3, 35.2, 35.3, 35.9, 36.2, 161, 164, 165, 166, 457, 464, 473, 224; 229/3.1, 3.5 MF, 3.5 R, 922, 923, 174, 175, 178, 40.1, 36.5

[56] References Cited

U.S. PATENT DOCUMENTS

| | | | |
|---|---|---|---|
| 2,018,070 | 10/1935 | Kreider, Jr. | 229/6 |
| 2,024,795 | 12/1935 | Claff | 229/34 |
| 2,155,057 | 4/1939 | Moore | 229/55 |
| 2,169,638 | 8/1939 | Gilfillan | 229/61 |
| 2,330,015 | 9/1943 | Stockes | 229/55 |
| 2,697,546 | 12/1954 | Bergstein | 229/34 |
| 2,871,152 | 1/1959 | Tobin | 154/43 |
| 2,904,238 | 9/1959 | Perry et al. | 229/40 |
| 3,055,575 | 9/1962 | Gerarc | 229/66 |
| 3,142,599 | 7/1964 | Chavannes | 156/210 |
| 3,349,990 | 10/1967 | Woodford | 229/55 |
| 3,372,861 | 3/1968 | Johnson et al. | 229/80 |
| 3,381,889 | 5/1968 | Laskow | 229/87 |
| 3,386,645 | 6/1968 | Powell | 229/55 |
| 3,391,856 | 7/1968 | Siegler | 229/87 |
| 3,394,867 | 7/1968 | Gregg | 229/37 |
| 3,445,053 | 5/1969 | Lotz | 229/87 |
| 3,494,457 | 2/1970 | Titchenal | 383/109 |
| 3,592,380 | 7/1971 | Gerard | 229/66 |
| 3,833,164 | 9/1974 | Dagostine | 229/37 |
| 3,851,815 | 12/1974 | Desmond et al. | 229/87 |
| 3,920,870 | 11/1975 | Ackerman et al. | 428/46 |
| 3,942,711 | 3/1976 | Desmond et al. | 229/39 |
| 3,948,436 | 4/1976 | Bambara | 229/55 |
| 3,983,277 | 9/1976 | Ackerman et al. | 428/46 |
| 4,005,814 | 2/1977 | Foster | 229/155 |
| 4,055,814 | 10/1977 | Foster | 229/39 |

(List continued on next page.)

FOREIGN PATENT DOCUMENTS

| | | |
|---|---|---|
| 1029870 | 5/1966 | United Kingdom . |
| 2186253 | 8/1987 | United Kingdom . |

*Primary Examiner*—Rena Dye

[57] ABSTRACT

A decorative sheet material which includes a first sheet which has a first side and a second side, an optional layer of cushioning material which, if present, is adhered to the first side of the first sheet, a second sheet which has a first side and a second side, the first side of which is positioned against the second side of the first sheet, the second sheet being made of paper, plastic, leather, fabric and/or metal/foil, a first adhesive layer which is placed against the second side of the second sheet, and a first outer plastic layer which is placed against the first adhesive layer. The decorative sheet material may also include sprinkles, glitter, sequins, feathers, shredded mylar, shredded foil, cut-outs and the like, which are positioned either between the first adhesive layer and the outer layer of plastic or between the first side of the second sheet and the first adhesive layer. There may be one or more ridges or grooves, or both, in the first outer plastic layer. The decorative sheet material may also include a second adhesive layer and a third sheet which has a first side and a second side, where the second adhesive layer is placed against the layer of cushioning material (or against the first sheet, if there is no layer of cushioning material) and the first side of the third sheet is placed against the second adhesive layer. The decorative sheet material may also include a third sheet which has a first side and a second side, a second adhesive layer and a second outer plastic layer, where the second adhesive layer is placed against the second side of the third sheet and the second outer plastic layer is placed against said second adhesive layer. The first sheet may be either an envelope or a cardboard box.

10 Claims, 8 Drawing Sheets

U.S. PATENT DOCUMENTS

| | | | |
|---|---|---|---|
| 4,126,727 | 11/1978 | Kaminski | 428/172 |
| 4,276,982 | 7/1981 | Sibrava et al. | 206/439 |
| 4,285,998 | 8/1981 | Thibodeau | 383/116 |
| 4,515,840 | 5/1985 | Gatward | 428/35 |
| 4,605,584 | 8/1986 | Herr, Jr. et al. | 428/142 |
| 4,674,129 | 6/1987 | Janhonen | 383/119 |
| 4,756,422 | 7/1988 | Kristen | 383/105 |
| 4,756,951 | 7/1988 | Wang et al. | 428/204 |
| 4,759,643 | 7/1988 | Canno | 383/84 |
| 4,765,535 | 8/1988 | Michetti | 229/172 |
| 4,784,314 | 11/1988 | Penick | 229/8 |
| 4,858,822 | 8/1989 | Johnson et al. | 229/137 |
| 4,916,007 | 4/1990 | Manning et al. | 428/203 |
| 4,921,746 | 5/1990 | Patriksson | 383/110 |
| 4,953,779 | 9/1990 | Densen | 229/23 |
| 4,967,952 | 11/1990 | Roessiger | 229/87.19 |
| 5,033,668 | 7/1991 | Cohen et al. | 229/186 |
| 5,065,935 | 11/1991 | Mancel | 229/40 |
| 5,186,988 | 2/1993 | Dixon | 383/37 |
| 5,223,322 | 6/1993 | Colyer et al. | 428/141 |
| 5,245,815 | 9/1993 | Savage | 53/449 |
| 5,246,765 | 9/1993 | Lussi et al. | 428/203 |
| 5,273,361 | 12/1993 | Jillson | 383/93 |
| 5,346,312 | 9/1994 | Mabry et al. | 383/105 |

DECORATIVE SHEET MATERIAL

BACKGROUND OF THE INVENTION

1. Field Of The Invention

The invention relates to decorative sheet material and, in particular, to decorative sheet material one layer of which may be an envelope or a box.

2. Description Of Background Art

Noted are U.S. Pat. Nos. 4,756,951, 2,871,152, 4,605,584, 5,223,322, 4,126,727, 4,916,007 and 5,246,765.

BROAD DESCRIPTION OF THE INVENTION

An object of the invention is to overcome some of the disadvantages of prior art envelopes, boxes and other packaging. Another object of the invention is to provide decorative packaging or containers, such as, decorative envelopes and decorative boxes, which are waterproof. Another object of the invention is to provide decorative envelopes and boxes which are sturdy and tear-resistant. Another object of the invention is to provide decorative envelopes and boxes which are attractive and festive in nature, and which do not need to be placed in another box or to be wrapped with mailing paper before being mailed. Other objects and advantages of the invention are set out herein or are obvious herefrom to one skilled in the art.

The objects and advantages of the invention are achieved by the decorative sheet material of the invention.

The invention involves decorative sheet material with a varying number of layers, for example, four, five, six, seven or more layers. In the form of decorative envelopes, the decorative sheet material generally, but not necessarily, comprises eight layers, namely, a sheet made of paper, cardboard, plastic, leather, fabric and/or metal/foil on one side of which is adhered a layer of cushioning material and on the other side of which is positioned a sheet of paper, plastic, leather, fabric and/or metal/foil, upon which is placed sprinkle(s), glitter, sequin(s), feathers, shredded mylar (other other plastic), shredded (metallic) foil, cut-outs and/or the like, upon which is placed an adhesive layer and, finally, upon which is placed an outer layer of transparent or translucent plastic.

When one is sending a present, for example, through the mail, depending upon the composition of that which is being mailed, the present must be placed in a box. Depending upon the type of box chosen, the box may need to be wrapped in mailing paper, for example, or may need to be placed into another, sturdier box, both of which take time and may cost money. This would be true, for example, if you were mailing a shirt you purchased at a department store for which you did not receive a box, or for which you received a flimsy box. Use of the present invention in the form of a decorative envelope or decorative package eliminates these needs. This is because the decorative envelope and decorative package of the instant invention are sturdy in construction and design. A shirt, for example, could be placed in either a decorative box or a decorative envelope of the appropriate size. Then, one would need only to seal shut the box or envelope and to apply the address labels onto its front side before mailing it.

Further, when one is sending a present through the mail, for example, one may desire to wrap the box or envelope encasing the present in attractive so-called wrapping paper. Most wrapping paper is neither water resistant nor water proof. Also, most, if not all, wrapping paper is not sturdy enough to be sent directly through the mail without some sort of protective layer thereon (another box or envelope, or so-called mailing paper) as it might rip or, at the very least, be stained or get dirty. The decorative sheet material of the instant invention is water proof, can not be torn, and can be washed, because of its outer layer of transparent or translucent (water impermeable) plastic. Thus, one can place a present one desires to mail somewhere in an attractive decorative envelope or box of the instant invention without, first, having to wrap it with wrapping paper and, then, having to encase the wrapping paper in some sort of protective layer (another box or envelope, or mailing paper). The decorative sheet material of the instant invention may include a layer of wrapping paper, mylar (or other plastic), metallic foil, fabric or other attractive material adjacent to the envelope or box, thus, giving it a home-wrapped appearance. Such layer/sheet may be colored or patterned (or with a design).

Further, when a layer of sprinkles, glitter, sequins, feathers, shredded mylar, shredded foil, cut-outs and/or the like is included as part of the decorative sheet material, this detail lends to the festive, attractive character of the envelope or box. Also, the use of a layer of sprinkles, glitter, sequins, feathers, shredded mylar (or other plastic), shredded (metallic) foil, cut-outs and/or the like results in decorative sheet material having a three-dimensional effect. If the adhesive layer is present between the outer layer of transparent and translucent plastic and the layer of sprinkles, glitter, sequins, feathers, shredded mylar (or other plastic), shredded (metallic) foil, cut-outs and/or the like, this three-dimensional effect is caused in part by the indentation of both the outer layer of transparent or translucent plastic and the adhesive layer between individual sprinkles, glitter, sequins, feathers, pieces of shredded mylar (or other plastic), pieces of shredded (metallic) foil, cut-outs and/or the like. If the adhesive layer is present instead beneath the layer of sprinkles, glitter, sequins, feathers, pieces of shredded mylar (or other plastic), pieces of shredded (metallic) foil, cut-outs and/or the like, the three-dimensional effect is still observed. In this latter instance, the three-dimensional effect is caused in part by the indentation of the outer layer of transparent and translucent plastic between individual sprinkles, glitter, sequins, feathers, pieces of shredded mylar (or other plastic), pieces of shredded (metallic) foil, cut-outs and/or the like. The observed three-dimensional effect gives the decorative sheets of the present invention a home-made quality, regardless of how they are manufactured. This home-made quality may be desirable, for example, to one mailing a present to a family member.

The presence of a layer of cushioning material serves to protect the contents of the box or envelope from the wears and tears of mailing system travel. If one is sending a present through the mail in a box or envelope lacking a layer of cushioning material, one may need to wrap the present, for example, in bubble-wrap. This step is eliminated when one is using the decorative envelopes or boxes of the instant invention.

When the decorative sheet material in the form of an envelope or box includes a second (inner) layer of wrapping paper, mylar (or other plastic), metallic foil, fabric or other attractive material adjacent to the layer of cushioning material, if the layer of cushioning material is present, or adjacent to the envelope or box layer, if the layer of cushioning material is not present, this adds to the attractive appearance and festive nature of this packaging. When, on top of this layer, there are, in addition, a layer of adhesive and a layer of transparent or translucent plastic, the contents of the envelope or box are further protected. For example, a present with sharp edges will not pierce one or more bubbles of the layer of bubble-wrap, if the layer of bubble-wrap is covered and protected by these additional layers.

The decorative sheet material in the form of a box or envelope is reusable. Even when the box or envelope has been mailed somewhere, the address labels and stamp(s) can be scraped off, and new ones can be applied.

Modifications and changes made to the decorative sheet material can be effected without departing from the scope or spirit of the present invention. For example, the decorative sheet material can be used on such materials as paper, cardboard, plastic, leather, fabric and/or metal/foil. Also, the embodiments of the decorative sheet material which are illustrated as follows have been shown only by way of example and should not be taken to limit the scope of the following claims.

DETAILED DESCRIPTION OF THE INVENTION

Figure 11:
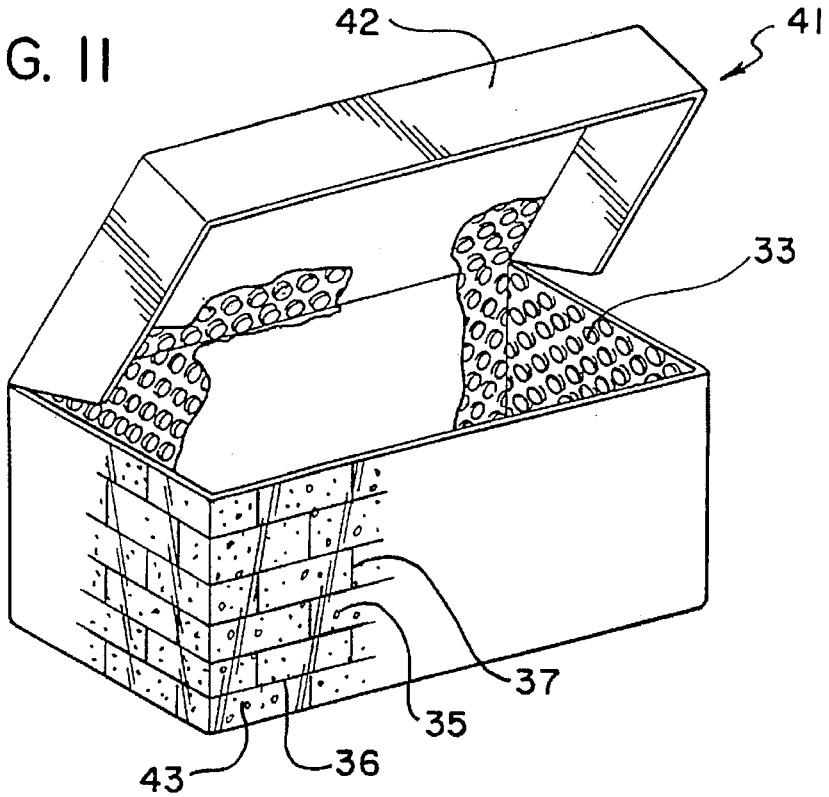
FIG. 11 is a perspective elevational view of the present invention in the form of a decorative box including a layer of bubble wrap in the interior of the box, a layer of sprinkles, glitter, sequins or cut-outs, and both vertical and horizontal ridges and/or grooves in the outer layer of transparent or translucent plastic.
Figure 12:
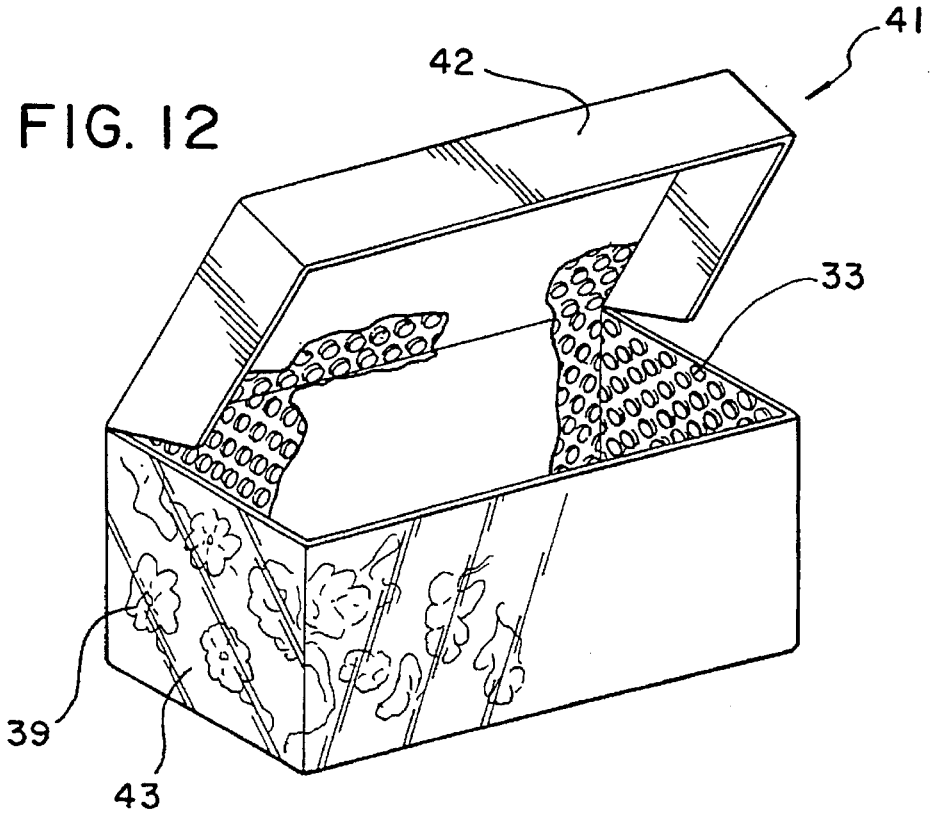
FIG. 12 is a perspective elevational view of the present invention in the form of a decorative box including a layer of bubble wrap and either large cut-outs or a pattern in the layer which is a sheet of paper, plastic, leather, fabric and/or metal/foil adjacent to the box.
Figure 13:
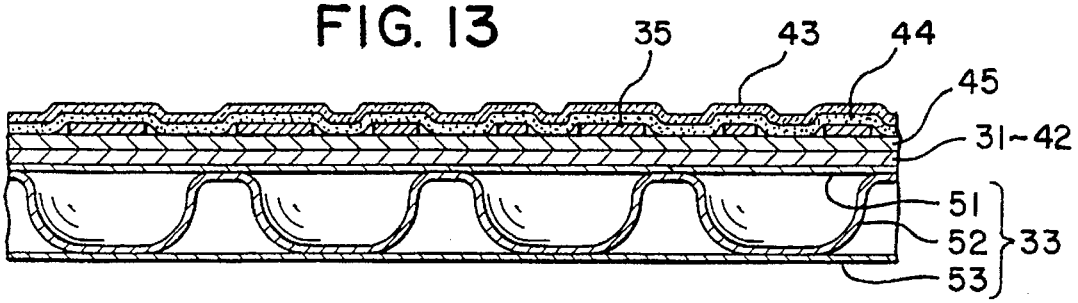
FIG. 13 is a cross-sectional view of the present invention including a layer of bubble wrap and a layer of sprinkles, glitter, sequins and/or cut-outs, where the layer of sprinkles, glitter, sequins and/or cut-outs is positioned between the adhesive layer and the sheet of paper, plastic, leather, fabric and/or metal/foil (45)

As shown in the accompanying drawings, FIGS. 1 to 4 and 9 to 12, the present invention in the form of decorative envelopes or boxes generally, but not necessarily, comprises seven layers (43, 44, 35, 45, 31, 33 and 52). Such figures lack inner sheet 53. The envelopes and boxes are described with the preferable embodiments of FIGS. 13 and 14 which have the additional eight layer 53. That is, the present invention in the form of decorative envelopes generally, but not necessarily, comprises a sheet made of paper, cardboard, plastic, leather, fabric and/or metal/foil (31) on one side of which is adhered a layer of cushioning material (33 or 51) and on the other side of which is positioned a sheet of paper, plastic, leather, fabric and/or metal/foil (45), upon which is placed sprinkle, glitter, sequins, feathers, shredded mylar (or other plastic), shredded (metallic) foil, cut-outs and/or the like (35), upon which is placed an adhesive layer (44) and, finally, upon which is placed an outer layer of transparent or translucent plastic (43). This combination is shown in FIG. 13.

Figure 14:
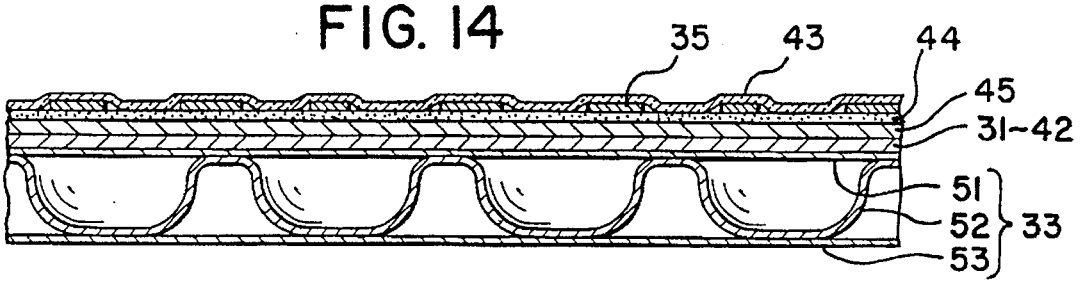
FIG. 14 is a cross-sectional view of the present invention including a layer of bubble wrap and a layer of sprinkles, glitter, sequins and/or cut-outs and where the layer of sprinkles, glitter, sequins and/or cut-outs is positioned between the outer layer of transparent or translucent plastic and the adhesive layer.
Figure 17:
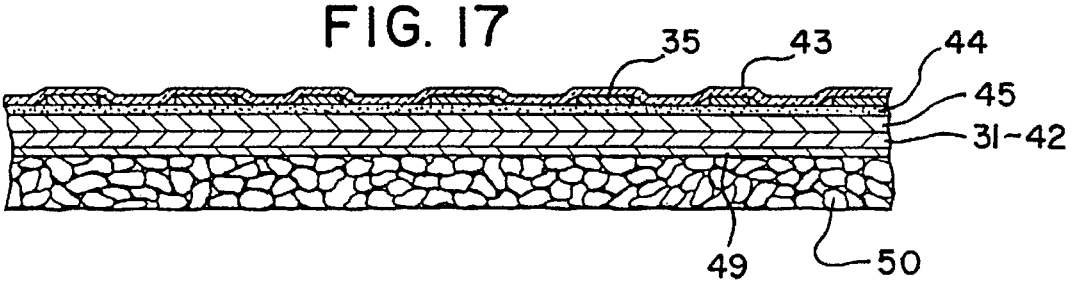
FIG. 17 is a cross-sectional view of the present invention including layers of foam, another adhesive layer adhering the foam layers to the sheet of paper, plastic, leather, fabric, cardboard and/or metal/foil or to a cardboard box, and a layer of sprinkles, glitter, sequins and/or cut-outs, where the layer of sprinkles, glitter, sequins and/or cut-outs is positioned between the outer layer of transparent or translucent plastic and the adhesive layer.

In the alternative, the adhesive layer (44) may be placed on the sheet of paper, plastic, leather, fabric and/or metal/foil (45). In this instance, the sprinkle, glitter, sequins, feathers, shredded mylar (or other plastic), shredded (metallic) foil, cut-outs and/or other particles (35), if present, are placed on the adhesive layer (44), and the outer layer of transparent or translucent plastic (43) is placed on the layer of adhesive (44). This combination is shown in FIGS. 14 and 17.

Plastic layer (43) can be colored to the extent of not preventing the layer from being at least translucent.

The inclusion of a sheet of paper, plastic, leather, fabric and/or metal/foil (45) is optional. Also, more than one sheet of paper, plastic, leather, fabric and/or metal/foil, adjacent to one another, can be present.

Figure 3:
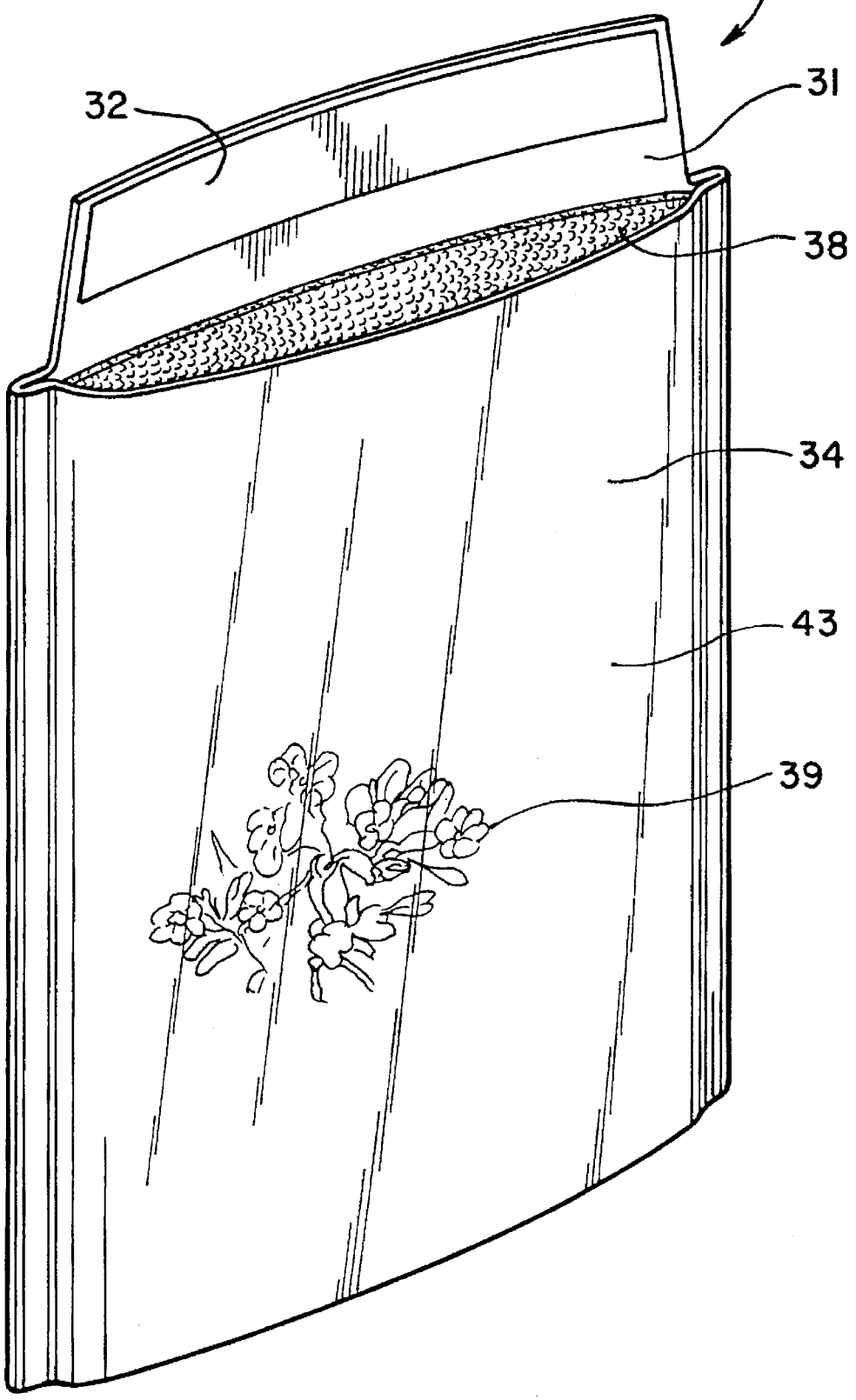
FIG. 3 is a perspective view of the present invention in the form of a decorative envelope including layers of foam and with either large cut-outs or a pattern in the layer which is a sheet of paper, plastic, leather, fabric and/or metal/foil adjacent to the envelope.
Figure 8:
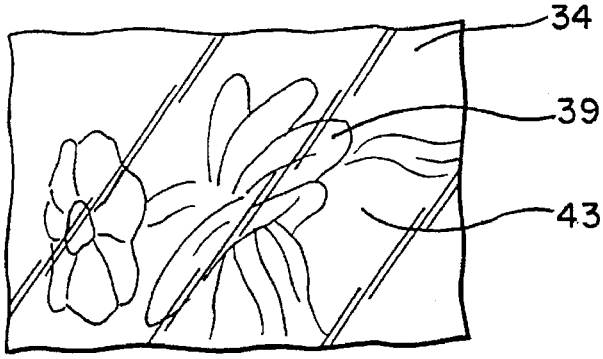
FIG. 8 is a front elevational view of a portion of decorative sheet material including either large cut-outs or a pattern in the visible layer which is a sheet of paper, plastic leather, fabric and/or metal/foil.
Figure 9:
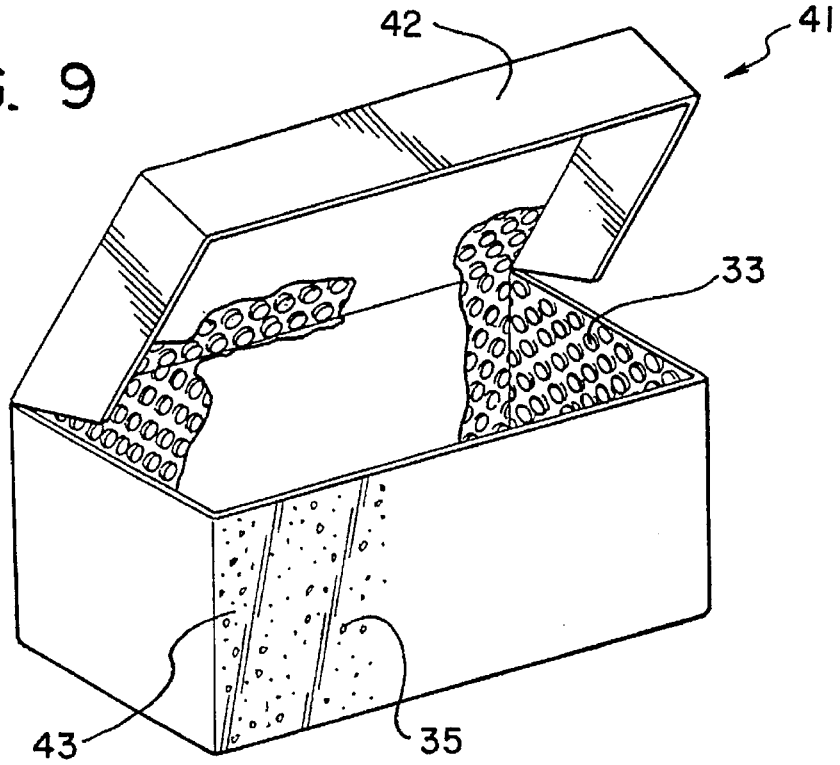
FIG. 9 is a perspective elevational view of the present invention in the form of a decorative box including a layer of bubble wrap in the interior of the box, and a layer of sprinkles, glitter, sequins or cut-outs.

The inclusion on a layer of sprinkles, glitter, sequins, feathers, shredded mylar (or other plastic), shredded (metallic) foil, cut-outs and/or other particles (35) is optional. FIGS. 3, 8 and 12 show combinations which can lack this layer. However, these figures show instead combinations including a layer of very large, flower-shaped cut-outs. The sprinkles, glitter, sequins, feathers, shredded mylar (or other plastic), shredded (metallic) foil, cut-outs and other particles (35) used can vary greatly in both size and color.

The use of a layer of sprinkles, glitter, sequins, feathers, shredded mylar (or other plastic), shredded (metallic) foil, cut-outs and/or other particles (35) results in decorative sheet material having a three-dimensional effect. If the adhesive layer (44) is present between the outer layer of transparent and translucent plastic (43) and the layer of sprinkles, glitter, sequins, feathers, shredded mylar (or other plastic), shredded (metallic) foil, cut-outs and/or other particles (35), this three-dimensional effect is caused in part by the indentation of both the outer layer of transparent or translucent plastic (43) and the adhesive layer (44) between individual sprinkles, glitter, sequins, feathers, shredded mylar (or other plastic), shredded (metallic) foil, cut-outs and/or other colored or non-colored particles (35). If the adhesive layer (44) is present instead beneath the layer of sprinkles, glitter, sequins, feathers, shredded mylar, shredded foil, cut-outs and/or other particles (35), the three-dimensional effect is still observed. In this latter instance, the three-dimensional effect is caused in part by the indentation of the outer layer of transparent and translucent plastic (43) between individual sprinkles, glitter, sequins, feathers, shredded mylar (or other plastic), shredded (metallic) foil, cut-outs and/or other particles. The observed three-dimensional effect gives the decorative sheets of the present invention a home-made appearance, regardless of how they are manufactured. This home-made appearance may be desirable, for example, when the decorative sheet material takes the form of an envelope or package. FIGS. 13 to 17 show this three-dimensional effect.

Figure 1:
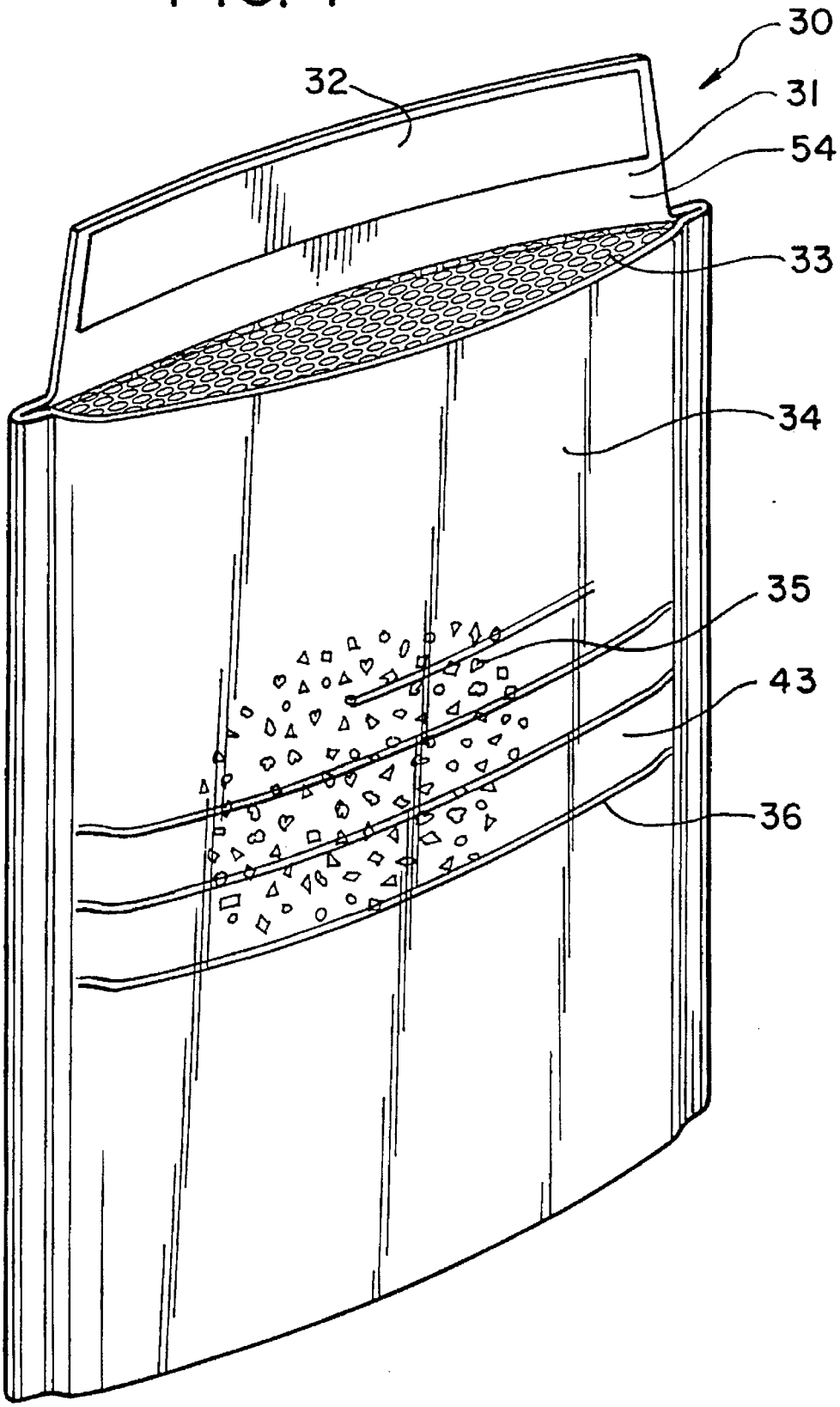
FIG. 1 is a perspective view of the present invention in the form of a decorative envelope including a layer of bubble wrap, a layer of sprinkles, glitter, sequins or cut-outs, and horizontal ridges and/or grooves in the outer layer of transparent or translucent plastic.
Figure 2:
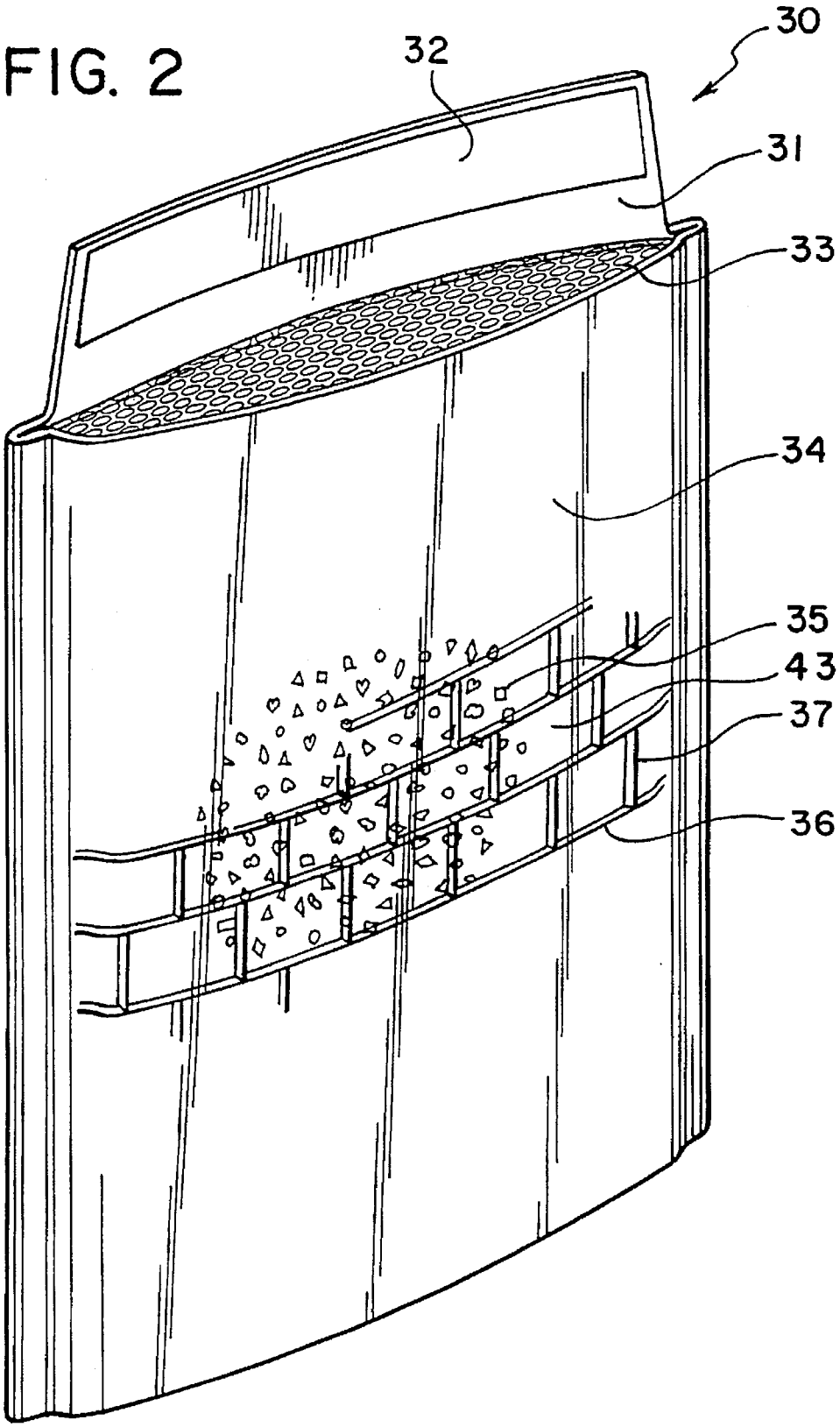
FIG. 2 is a perspective view of the present invention in the form of a decorative envelope including a layer of bubble wrap, a layer of sprinkles, glitter, sequins or cut-outs, and a grid of both vertical and horizontal ridges and/or grooves in the outer layer of transparent or translucent plastic.
Figure 4:
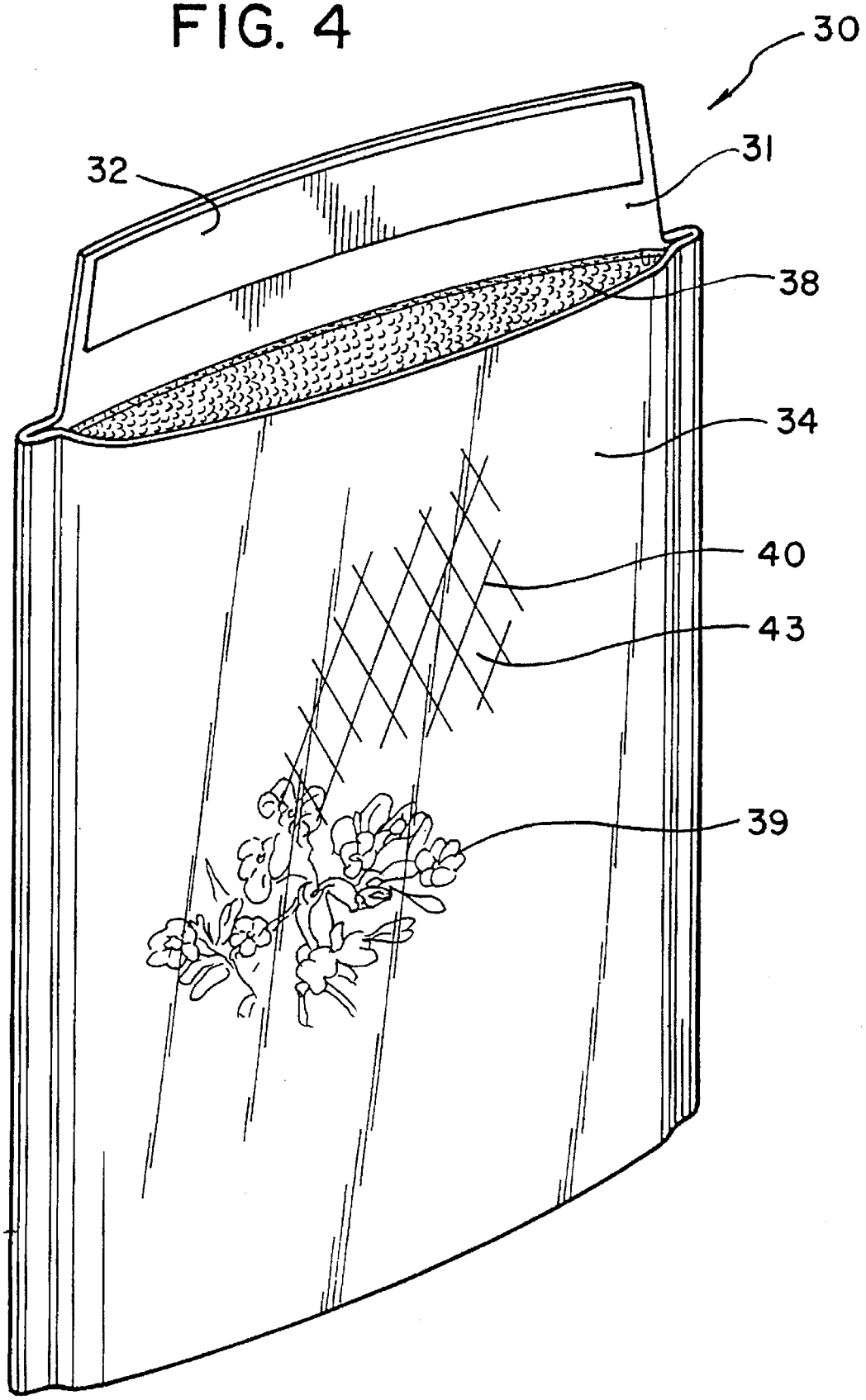
FIG. 4 is a perspective view of the present invention in the form of a decorative envelope including layers of foam, a grid of diamond-shaped ridges and/or grooves in the outer layer of transparent or translucent plastic, and either large cut-outs or a pattern in the layer which is a sheet of paper, plastic, leather, fabric and/or metal/foil adjacent to the envelope.
Figure 5:
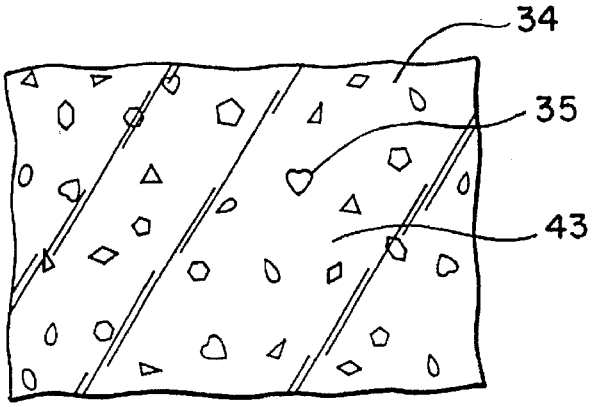
FIG. 5 is a front elevational view of a portion of decorative sheet material including a layer of sprinkles, glitter, sequins or cut-outs.
Figure 6:
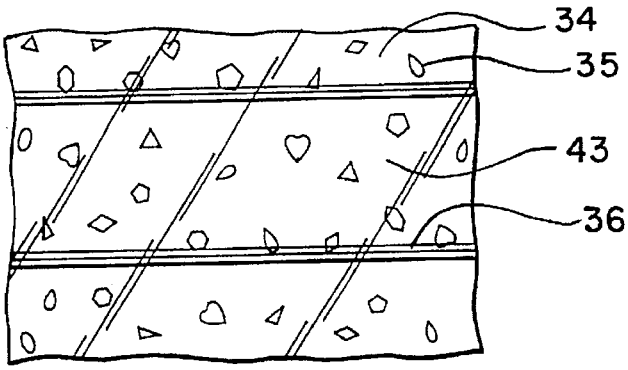
FIG. 6 is a front elevational view of a portion of decorative sheet material including a layer of sprinkles, glitter, sequins or cut-outs, and horizontal ridges and/or grooves in the outer layer of transparent or translucent plastic.
Figure 7:
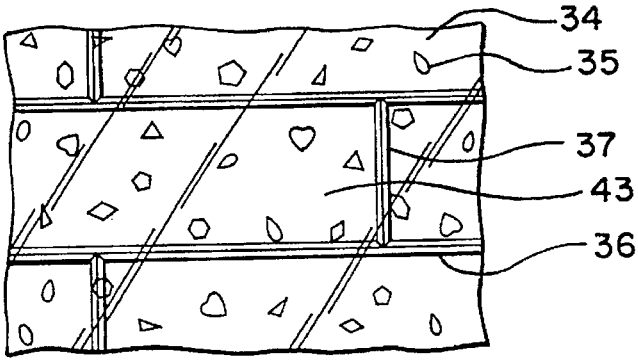
FIG. 7 is a front elevational view of a portion of decorative sheet material including a layer of sprinkles, glitter, sequins or cut-outs, and both vertical and horizontal ridges and/or grooves in the outer layer of transparent or translucent plastic (which can be colored)
Figure 10:
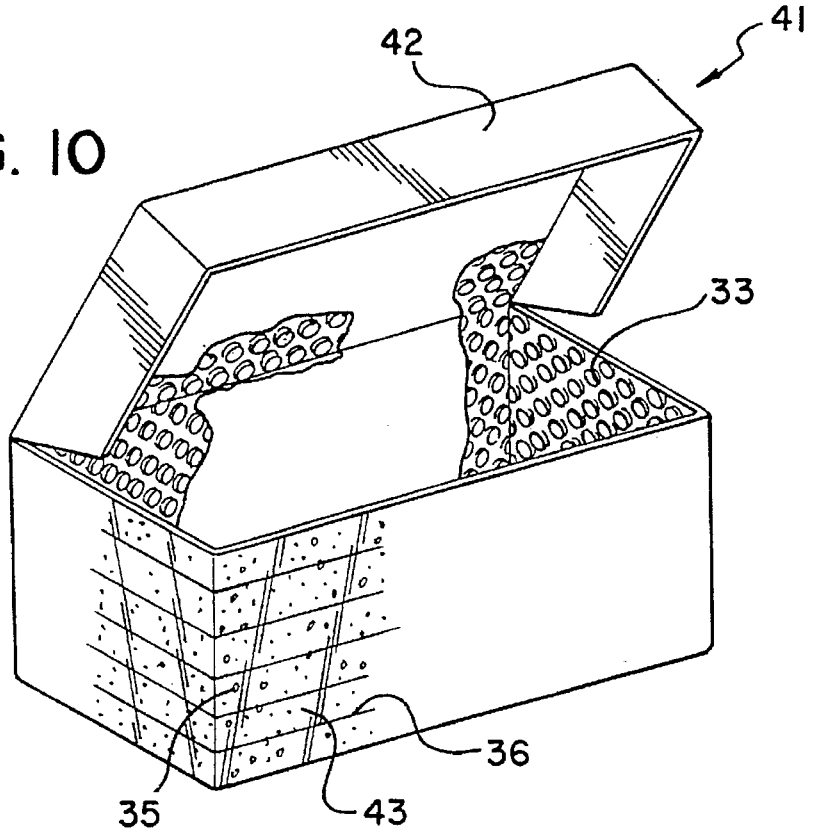
FIG. 10 is a perspective elevational view of the present invention in the form of a decorative box including a layer of bubble wrap in the interior of the box, a layer of sprinkles, glitter, sequins or cut-outs, and horizontal ridges and/or grooves in the outer layer of transparent or translucent plastic.
Figure 15:
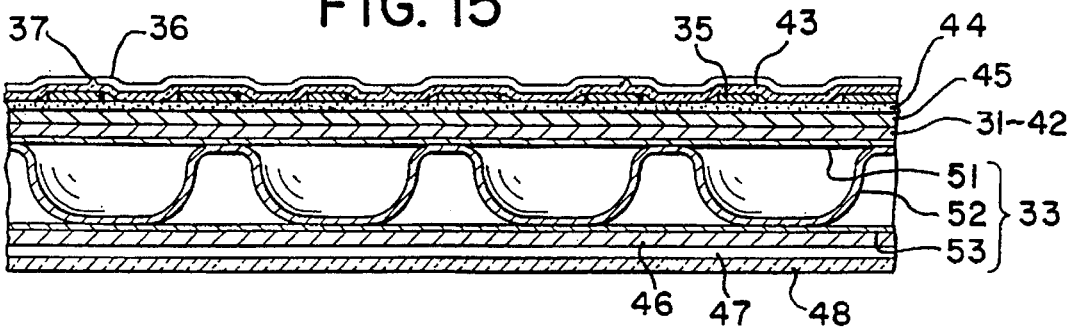
FIG. 15 is a cross-sectional view of the present invention including a layer of bubble wrap, a layer of sprinkles, glitter, sequins and/or cut-outs,ridges and/or grooves, another sheet of paper, plastic, leather, fabric and/or metal/foil (46), another layer of adhesive (47) and another layer of transparent or translucent plastic (48), and where the layer of sprinkles, glitter, sequins and/or cut-outs is positioned between the adhesive layer and the sheet of paper, plastic, leather, fabric and/or metal/foil (45)

Ridges or grooves, or both, may be present in the outer layer of transparent or translucent plastic (43). These ridges and/or grooves can be part of any design or configuration. FIG. 15 shows a cross-section of decorative sheet material having ridges. FIGS. 1, 6 and 10 show horizontal ridges or grooves. FIGS. 2, 7 and 11 show grids of both horizontal and vertical ridges or grooves. FIG. 4 shows grids of diamond-shaped ridges or grooves. When ridges and/or grooves are present, these ridges and/or grooves add to the overall three-dimensional appearance of the sheet material.

Figure 16:
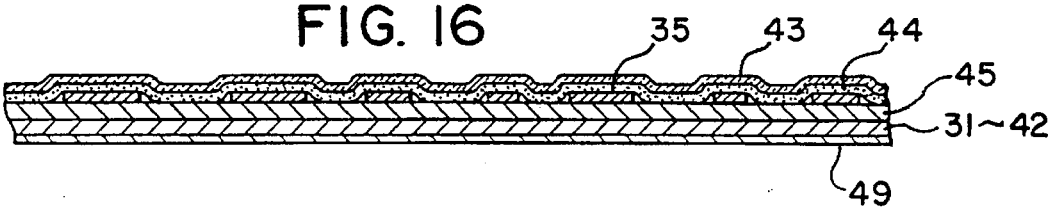
FIG. 16 is a cross-sectional view of the present invention including a layer of sprinkles, glitter, sequins and/or cut-outs and another sheet of paper, plastic, leather, fabric and/or metal/foil (46), and where the layer of sprinkles, glitter, sequins and/or cut-outs is positioned between the adhesive layer and the sheet of paper, plastic, leather, fabric and/or metal/foil (45)

The use of a layer of cushioning material (33 or 51) can be optional, but provides advantages in various invention embodiments. If used, the layer of cushioning material (33 or 51) can be a layer of bubble-wrap or a layer of foam or foam-like material. FIGS. 1, 2, 9, 10, 11, 12, 13, 14 and 15 show the use of a layer of bubble-wrap as the layer of cushioning material. Preferably layer 53 is located on the inner surface of the cushioning material to provide protection thereof and can be colored, non-colored, opaque, transparent, translucent, etc. FIGS. 3, 4 and 17 show the use of foam or foam-like material as the layer of cushioning material. Layer 53 is preferably present. FIG. 16 shows a combination lacking a layer of cushioning material. (Note that FIG. 16 shows a sheet of paper, plastic, leather, fabric and/or metal/foil, which may include one or more colors (49), positioned where the layer of cushioning material would be, that is, against the sheet of paper, cardboard, plastic, leather, fabric and/or metal/foil (31)). If the layer of cushioning material is a layer of bubble wrap, the layer of bubble wrap may comprise three layers of plastic—an outer sheet of plastic (52), an inner sheet of plastic (54) and a middle sheet of plastic which forms bubbles against the outer and inner sheets of plastic.

In addition to the possible placement of a sheet of paper, plastic, leather, fabric and/or metal/foil (46) adjacent to the layer of cushioning material (on the opposite side from the sheet of paper, cardboard, plastic, leather, fabric and/or metal/foil (31)), a layer of adhesive (47) may be placed adjacent to the sheet of paper, plastic, leather, fabric and/or metal/foil (46) with a layer of transparent or translucent plastic (48) placed adjacent to the sheet of paper, cardboard, plastic, leather, fabric and/or metal/foil (31).

The sheet of paper, cardboard, plastic, leather, fabric and/or metal/foil (31) may take the form of an envelope or a cardboard box. In FIGS. 1 to 4, the sheet of paper, cardboard, plastic, leather, fabric and/or metal/foil is in the form of an envelope. The envelope may or may not have a lip (54) with an adhesive strip (32) thereon [which is a glue that adheres upon contacting moisture, or is an (pressure, e.g.) adhesive having a conventional removable cover strip, or the like]. Any other suitable or conventionable closure means can be used. In FIGS. 9 to 12, the sheet of paper, cardboard, plastic, leather, fabric and/or metal/foil is in the form of a cardboard box.

Both sheets of paper, plastic, leather, fabric and/or metal/foil (45 and, if present, 46) may be black, a solid color or include more than one color. If more than one color is present, the colors may form a simple or intricate design. The sprinkle, glitter, sequins, feathers, shredded mylar (or other plastic), shredded (metallic) foil and cut-outs, one or more of which may be present, may be any color (plus black), or any combination of colors (plus black). Likewise, the sheet of paper, cardboard, plastic, leather, fabric and/or metal/foil (31) and the outer layer of transparent or translucent plastic, including any ridges and/or grooves therein, may be any color (plus black), or any combination of colors (plus black).

Adhesive layer 44 is a relatively thick layer (e.g., readily visable in cross-section) of adhesive, such as, and adhesive gum used on adhesive tape. Any suitable adhesive can be used which is at least translucent enough not to obscure any underlying particles, patterns, designs or the like. Other layers such as 45, 31, 42, 51, 53, 46, etc., can be fused together or adhered together (with a relatively thin layer of adhesive).

The various layers (other than these associated with adhesive layer 44) do not have to be bonded/adhered together over their entire surfaces. Usually the bonding/adhering is sufficient if done around the periphery or edges. FIG. 1, for example, shows the two side edges of the envelopes "pinched together", that is, the inside surfaces adhered together for a short distance inwards. The outside layers can be lapped over the top edge of the envelope so they can be bonded/adhered to the top of the envelope's inside surface—likewise for the invention boxes. The bubble wrap in the envelopes may be only adhered around its edges. However, with boxes, it is often desirable to also adhere the bubble wrap at the box folds (seams) to keep the bubble wrap from sagging into the box. Usually, the bubble wrap is adhered (as opposed to free floating) over its entire surfaces to other layers.

The invention sheet material, besides for forming boxes and envelopes, can be used for: children's recreational/school supplies utility, such as, notebook and folder covers, book covers, crayon (crayola) boxes (covering), school supplies' box coverings (e.g., pencils, erasers, sharpeners, rulers, etc.), lunch box covering, lunch boxes, toy boxes or trunk covering, doll house (covering) and doll and toy storage units; home and garden utility, such as, plant and flower containers/boxes, fishing bait and tackle boxes/containers, cigar and tobacco containers/boxes, and jewelry boxes; incoming and received mail in house mail, and boxes for bills and letters; kitchen utility, such as, freezer containers/boxes (storing gourmet coffee and the like), refrigerator storage units/boxes containers (vegetable, cheeses, eggs and the like), cookie box, candy boxes, bread boxes, fruit boxes, and shelf liners; storage box utility, such as, dresser drawer cardboard clothing utility, clothing trunks, lingerie boxes, and hope chest and treasure chest coverings; table and desk top utility, such as, baby changing table (covers), desk top covers, table covers, table cloths, place mats, wall coverings and sun resters or shades for car windows, (e.g., front windows); and dining and recreational utility, such as, picnic basket covers/liners, plastic cardboard dining utensils, picnic chair and dining chair cushion covers, baby car seat coverings, baby high chair seat covering and baby high chair top food serving area covering.

The inner or lower surface can also be made waterproof and washable by use of a layer of (water impermeable) plastic.

U.S. Pat. No. 4,756,951 (Wang et al.) discloses a decorative surface covering, and a method of and an apparatus for making this decorative surface covering. For example, Wang et al. discloses a transparent or translucent layer which contains a platey material oriented at two or more different angles with respect to the surface of the layer. This element is not present in the instant invention. Among other differences, U.S. Pat. No. 2,871,152 (Tobin) discloses laminated tiles having a plurality of fiber glass mats arranged in laminated relation which are not present in the instant invention. U.S. Pat. No. 4,605,584 (Herr et al.) discloses decorative materials comprising crinkled chips. Among other differences, Herr et al. al. discloses a particulate vinyl resin which is not present in the instant invention. U.S. Pat. No. 5,223,322 (Colyer et al.) discloses both decorative surface covering with controlled platelet layer orientation, and for a method for making this decorative surface covering. Unlike the sprinkle, glitter, sequins, feathers, cut-outs and the like which may be present as a layer in the instant invention, Colyer et al. discloses aligning the platelets in a platey material at particular predetermined angles. Another example of a difference between what is disclosed in these patents and the instant invention is that Wang et al., Tobin, Herr et al. and Colyer et al. do not appear to contain an adhesive layer. The instant invention includes at least one adhesive layer. U.S. Pat. No. 4,126,727 (Kaminski) discloses a resinous polymer sheet having selective, decorative effects. Included is a second layer of a resinous polymer composition coupled on and adhered to a printed pattern or design and to a first layer of a resinous polymer composition. Numerous differences exist between that which is disclosed and claimed in Kaminski and the instant invention. For example, Kaminski claims a second layer of resinous polymer composition having a refractive index of from about 1.3 to about 1.7. The instant invention does not include this limitation. U.S. Pat. No. 4,916,007 (Manning et al.) discloses underprinted inlaid sheet materials having unique decorative design effects. A clear adhesive layer containing decorative particles is disclosed. Manning et al. claims a pattern or design printed on the surface of a first layer of resinous polymer composition. This pattern or design must have 2 or more distinguishably different, colored printed portions. Among other differences between Manning et al. and the instant invention, the latter does not include this limitation. U.S. Pat. No. 5,246,765 (Lussi et al.) is for decorative inlaid types of sheet materials for commercial use. Lussi et al. claims, for example, an adhesive matrix layer in which is embedded spherical or spheroidal particles having an aspect ratio no greater than about 2:1. The instant invention includes no such limitation.

LIST OF PARTS NUMBERS

In connection with the figures, the following list of the names of the parts of the instant invention are noted:

30 decorative envelope;
31 sheet of paper, plastic, glass, cardboard and/or metal;
32 adhesive strip on lip of envelope;
33 layer of bubble wrap;
34 panel of envelope;
35 sprinkle, glitter, sequin and/or cut-out;
36 horizontal groove or ridge in outer layer of transparent or translucent plastic;
37 vertical groove or ridge in outer layer of transparent or translucent plastic;
38 layer of foam;
39 large cut-out or design on clear or colored layer adjacent to cardboard or paper or plastic envelope layer;
40 diamond-shaped ridges or grooves in outer layer of transparent or translucent plastic;
41 decorative package;
42 cardboard box;
43 outer layer of transparent or translucent plastic;
44 layer of adhesive;
45 sheet of paper, plastic and/or metal, which may include one or more colors;
46 sheet of paper, plastic and/or metal, which may include one or more colors;
47 layer of adhesive;
48 layer of transparent or translucent plastic;
49 adhesive joining layers of foam to paper or plastic envelope or cardboard box;
50 layers of foam;
51 outer sheet of plastic;
52 middle sheet of plastic forming bubbles against the outer and inner sheets of plastic;
53 inner sheet of plastic; and
54 lip of envelope.

What is claimed is:

1. A multilayer gift package comprising:

(a) a package container comprised of a cushioned envelope, the cushioned envelope having an inside surface and an outside surface, said cushioned envelope being comprised of a first wall element facing a second wall element, joined together at all but one set of lateral edges thereof to define a chamber having one open end, the first wall element at said open end of said chamber extending beyond said second wall element and being adapted to be foldable over part of the second wall element at said open end of said chamber;

(b) a first inner layer having a first surface and a second surface, the first surface of the first inner layer being adhered to the inside surface of the cushioned envelope, the first inner layer being a sheet of decorative paper of at least one color, or of decorative foil material of at least one color;

(c) a second inner layer adhered to the second surface of the first inner layer by means of a transparent adhesive material, the second inner layer being a sheet of transparent plastic material;

(d) a first outer layer having a first surface and a second surface, the first surface of the first outer layer being adhered to the outside surface of the cushioned envelope, the first outer layer being a sheet of decorative paper having at least one color printed on its second surface; and (e) a second outer layer adhered to the second surface of the first outer layer by means of a transparent layer of adhesive material, the second outer layer being a sheet of transparent plastic material, adhesive means being located on said first wall element extending beyond said second wall element or on said second inner layer thereon, and being adapted to adhere to said second outer layer when said first wall element extending beyond said second wall element is folded over.

2. The multilayer gift package as claimed in claim 1, wherein the cushioned envelope is comprised of a paper layer, which has a first surface and a second surface, and a cushion layer which is adhered to the second surface of the paper layer, said surface of said first outer layer being adhered to said first surface of said paper layer.

3. The multilayer gift package as claimed in claim 1, wherein the cushioned envelope is comprised of a paper layer, which has a first surface and a second surface, and a bubble wrapper layer which is adhered to the second surface of the paper layer, said surface of said flint outer layer being adhered to said first surface of said paper layer.

4. The multilayer gift package as claimed in claim 1, wherein the cushioned envelope is comprised of a layer of foam between two sheets of paper.

5. The multilayer gift package as claimed in claim 3, wherein at least one member selected from the group consisting of sprinkles, glitter, sequins, feathers, shredded mylar, shredded foil and cut-outs is located between the second surface of the first outer layer and the second outer layer and is adhered to the first outer layer.

6. The multilayer gift package as claimed in claim 3, wherein said layer of bubble wrap is made from three sheets of plastic, an inner sheet of plastic, an outer sheet of plastic and a middle sheet of plastic attached to said inner sheet of plastic and said outer sheet of plastic to form bubbles.

7. The multilayer gift package as claimed in claim 1, wherein said transparent plastic material sheet (c) is a contiguous, unitary sheet, said transparent plastic material sheet (e) is a contiguous unitary sheet, and said adhesive means is a pressure-sensitive adhesive having a removable cover strip thereover.

8. A multilayer gift package, comprising:

(a) a package container comprised of a box, the box having an inside surface and an outside surface, said box having a bottom wall element, side wall elements and a top wall element, a lateral edge of said top wall element being hingedly joined together to an opposite lateral edge of one of said side wall elements, at least one other lateral edge of said top wall element extending beyond at least one corresponding said side wall element and being adapted to be foldable over part of said at least one corresponding said side wall element;

(b) a first inner layer having a first surface and a second surface, the first surface of the first inner layer being adhered to the inside surface of the box, and the first inner layer being a sheet of decorative paper of at least one color, or of decorative foil material of at least one color;

(c) a second inner layer adhered to the second surface of the first inner layer by means of a transparent adhesive material, the second inner layer being a sheet of transparent plastic material;

(d) a first outer layer having a first surface and a second surface, the first surface of the first outer layer being adhered to the outside surface of the box, the first outer layer being a sheet of decorative paper having at least one color printed on its second surface; and (e) a second outer layer adhered to the second surface of the first outer layer by means of a transparent layer of adhesive material, the second outer layer being a sheet of transparent plastic material, adhesive means being located on said at least one other lateral edge of said top wall element extending beyond said at least one corresponding said side wall element or on said second inner layer thereon, and being adapted to adhere to said second outer layer when said at least one other lateral edge of said top wall extending beyond said at least one corresponding said side wall element is folded.

9. The multilayer gift package as claimed in claim 8, wherein said transparent plastic material sheet (c) is a contiguous, unitary sheet, said transparent plastic material sheet (e) is a contiguous, unitary sheet, and said adhesive means is a pressure-sensitive adhesive having a removable cover strip thereover.

10. The multilayer gift package as claimed in claim 8, wherein at least one member selected from the group consisting of sprinkles, glitter, sequins, feathers, shredded mylar, shredded foil and cut-outs is located between the second surface of the first outer layer and the second outer layer and is adhered to the first outer layer.

* * * * *